US006097302A

United States Patent [19]

Zinzell

[11] Patent Number: 6,097,302

[45] Date of Patent: Aug. 1, 2000

[54] SYSTEM AND METHOD FOR MONITORING A PLURAL SEGMENT LIGHT-EMITTING DISPLAY

[75] Inventor: Gary M. Zinzell, Pittsburgh, Pa.

[73] Assignee: Union Switch & Signal, Inc., Pittsburgh, Pa.

[21] Appl. No.: 09/339,333

[22] Filed: Jun. 23, 1999

[51] Int. Cl.[7] ..... G09F 9/00

[52] U.S. Cl. ..... 340/815.44; 340/580; 340/640; 340/324; 340/336; 345/34; 345/46; 345/117; 345/54; 315/152

[58] Field of Search ..... 340/815.44, 580, 340/641, 324, 336; 345/34, 46, 117, 54; 315/152

[56] References Cited

U.S. PATENT DOCUMENTS

| | | | |
|---|---|---|---|
| 3,573,814 | 4/1971 | Lang | 340/381 |
| 3,790,946 | 2/1974 | Hendricks | 340/336 |
| 4,095,217 | 6/1978 | Tani et al. | 340/324 |
| 4,214,391 | 7/1980 | Angst | 40/451 |
| 4,242,677 | 12/1980 | Jonath | 340/715 |
| 4,247,852 | 1/1981 | Utzinger | 340/715 |
| 4,297,692 | 10/1981 | Maier | 340/715 |
| 4,311,993 | 1/1982 | Strobel | 340/641 |
| 4,408,869 | 10/1983 | Tomosada et al. | 355/14 |
| 4,420,748 | 12/1983 | Jürgen | 340/715 |
| 4,541,066 | 9/1985 | Lewandowski | 364/580 |
| 4,592,003 | 5/1986 | Kobayashi et al. | 364/579 |
| 4,644,341 | 2/1987 | Warner | 340/753 |
| 4,654,629 | 3/1987 | Bezos et al. | 340/87 |
| 4,734,688 | 3/1988 | Adams | 340/715 |
| 4,847,606 | 7/1989 | Beiswenger | 340/712 |
| 4,951,037 | 8/1990 | Goossen | 340/715 |
| 5,160,920 | 11/1992 | Harris | 340/765 |
| 5,406,301 | 4/1995 | Ravid | 345/34 |
| 5,446,564 | 8/1995 | Mawatari et al. | 359/72 |
| 5,515,390 | 5/1996 | Benton | 371/57.1 |
| 5,559,528 | 9/1996 | Ravid et al. | 345/117 |
| 5,703,607 | 12/1997 | Tai | 345/34 |
| 5,812,102 | 9/1998 | Sprole, Jr. et al. | 345/34 |
| 5,831,693 | 11/1998 | McCartney, Jr. et al. | 349/42 |
| 5,838,290 | 11/1998 | Kuijk | 345/91 |

*Primary Examiner*—Daniel J. Wu
*Assistant Examiner*—Tai T. Nguyen
*Attorney, Agent, or Firm*—Kirk D. Houser; David V. Radack; Eckert Seamans Cherin & Mellott, LLC

[57] ABSTRACT

A monitoring system for a display unit includes phototransistors for detecting light emitted from a plurality of selectively energizable light-emitting diode (LED) segments in an energized state and for generating a voltage which is representative of the light emitted from the LED segments in the energized state. A glass filter filters ambient light from the phototransistors and passes the light emitted from the LED segments in the energized state. A comparator for each of the LED segments generates a comparison signal, with the comparison signal being representative of a comparison between a predetermined reference voltage and the voltage for each of the LED segments. A conditional power supply conditionally energizes the LED segments in response to an energizing signal. A routine of a central processing unit generates display data. The CPU receives the comparison signal for each of the LED segments and generates the energizing signal in order to operate the conditional power supply when the comparison signal for each of the LED segments indicates that each of the LED segments is operating fault-free. A control block cooperates with the conditional power supply and the CPU for selectively gating the display data to the LED segments.

21 Claims, 4 Drawing Sheets

SYSTEM AND METHOD FOR MONITORING A PLURAL SEGMENT LIGHT-EMITTING DISPLAY

BACKGROUND OF THE INVENTION

1. Field of the Invention

This invention relates to displays which utilize a plurality of individually energizable segments to form a digit or other symbol and, more particularly, to a system and method for monitoring the fail-safe operation of such displays.

2. Background Information

Monitoring of segment type indicators is particularly important, since failure of an individual segment may result in a false indication which may not be recognizable as such. In the case of light-emitting diodes (LEDs), one solution to this problem has been to monitor the voltage across and the current flowing through the individual segments. For liquid crystal displays (LCDs), such method is not practical, since the currents to be monitored are very small.

Referring to FIGS. 1 and 2, a seven-segment LED display 1 typically comprises segments 2,3,4,5,6,7,8 which are selectively and independently driven by a display driver 10. As shown in FIG. 2, diode segments 2,3,4,5,6,7,8 are typically independently coupled between the display driver 10 and electrical ground through respective current-limiting resistors 12,13,14,15,16,17,18. Although only one seven-segment display 1 is shown in FIGS. 1 and 2, it is understood that a plurality of seven-segment displays may be arranged together in manners known in the art, thereby displaying a plurality of alphanumeric characters, symbols and/or shapes.

U.S. Pat. No. 5,703,607 discloses a drive circuit employing flip-flops and AND, OR and NOT gates for displaying seven-segment decimal digits and a partition symbol (":").

U.S. Pat. No. 5,838,290 discloses an LCD device in which an internal auxiliary voltage, which is used for control, is obtained via a photovoltaic generator or converter having a plurality of series-connected photo-sensitive diodes.

U.S. Pat. No. 5,831,693 discloses an active matrix LCD panel including a viewing area and ambient light sensors, such as photodiodes, placed on the periphery of the panel. The panel also includes a lower glass substrate and an upper glass substrate having deposited thereon filter material including red, green and blue material. A transparent conductor is deposited on the filter material to form a common plate of pixel elements. A second opposing plate is deposited on the lower glass substrate, with an individual plate deposited opposite each filter to control each red, green and blue pixel. The photodiodes output a voltage directly proportional to the ambient light intensity. The output voltage, in turn, is employed to directly control the intensity of an LCD backlight.

Various prior proposals have addressed the possible failure of display circuits. U.S. Pat. No. 5,559,528 discloses LCD and LED display circuits which employ redundant segments in order that segment failures are readily visually apparent.

U.S. Pat. No. 5,515,390 discloses an error detection apparatus for an LCD or any form of electro-optic display whose elements are capacitive, such as an electroluminescent display. A comparator compares a voltage which is across the drive electrodes of the LCD element under test with a reference voltage. A resistor is connected across the drive electrodes to allow a controlled discharge of the parasitic capacitance under open circuit conditions of the element. When an incorrect electrode potential is detected, a control circuit generates an error warning, which can automatically prevent further operation (e.g., in a fuel dispenser application) until the fault is rectified. In this manner, an open circuit failure in the connections to, or within, the drive electrodes of the LCD, is detected.

U.S. Pat. No. 4,654,629 discloses a vehicle marker light using an array of LEDs in combination with lenses, such as Fresnel lenses, to provide a light beam of required intensity, shape and color for railroad applications. Voltage sensing circuitry, which includes a comparator and a reference voltage, senses the failure of the LEDs in the array and provides an indication of the failure.

In the railroad industry, "vital" is a term applied to a product or system that performs a function that is critical to safety, while "non-vital" is a term applied to a product or system that performs a function that is not critical to safety. Additionally, "fail-safe" is a design principle in which the objective is to eliminate the hazardous effects of hardware or software faults, usually by ensuring that the product or the system reverts to a state known to be safe.

For example, one of the components in the railroad industry which is included within an Automatic Train Protection (ATP) system is an Aspect Display Unit (ADU). The ATP receives signals from the rails which indicate the current maximum allowable speed for the locomotive. The ATP may then indicate this speed to the operator of the locomotive by controlling lights, called "aspects," on the ADU which is typically located between the two front windows or in the dash of the locomotive.

In many systems, the ADU is a non-vital element (i.e., not safety critical), since the ATP keeps the locomotive operating at or below the maximum allowable speed at all times by removing pressure from the brake system, thereby applying emergency brakes. In some systems, however, the ADU is a vital element since the ability of the system to control the brake system is either not available or can be selectively bypassed.

The "aspects" are normally light bulbs or blocks of LEDs which can be controlled using "vital outputs" whose failure modes result in removing voltage from across the LEDs. Conceptually, removing voltage from across the LEDs is easy to do since removing power ensures that the aspects will be dark, which has the same meaning as a zero mile-per-hour (MPH) allowable speed indication. Additionally, if the light bulbs or LEDs fail or burn out, then the aspect will go dark, thereby, providing a safe zero MPH allowable speed indication.

A problem with a seven-segment LED display results if one segment fails or is turned off inadvertently. Hence, the displayed allowable speed could actually increase in value. For example, if 80 MPH is the intended speed to be displayed with two seven-segment displays, and if the left bottom element (i.e., segment 7 of FIG. 1) in the seven-segment display for the "8" fails or is turned off, then the seven-segment display would show a "9" instead of an "8" and the speed shown would become 90 MPH instead of the intended 80 MPH. In other words, if a segment or its connection is damaged, then a wrong number could be displayed. As a further example, an "8" could be displayed as a "6" or a "0". For this reason, the fact that the output driving a particular LED is in the "on" state does not necessarily indicate that the LED is emitting light and showing a correct display.

U.S. Pat. No. 5,812,102 discloses two phototransistors as light sensors. The first phototransistor measures light transmitted from selectably energizable LEDs used to create a seven-segment display. The second phototransistor attempts to measure ambient light transmitted from external sources. Each segment of the display is surrounded by an opaque light shield to eliminate light transmissions from other segments in the ADU. A seven-segment display includes seven segments having seven primary photo-transistors and seven ambient photo-transistors enclosed within seven independent defined areas by seven shields, respectively. Because two phototransistors are enclosed in a transparent case, light refracted from the back of the segment can reach the phototransistors. In addition, some light reflected by the light shield reaches the second phototransistor. These effects reduce the sensitivity of the detection circuit. Accordingly, there is room for improvement.

SUMMARY OF THE INVENTION

The invention is directed to a plural segment display monitor which employs an ambient light filter, phototransistors which detect light emissions from the segments, and comparators to determine whether corresponding segments are properly energized or de-energized. The filter passes the transmission wavelengths of the segments and filters external ambient light wavelengths from the phototransistors. The comparator compares the output level of the phototransistor to a predetermined value to determine if the corresponding segment is on or off, as intended. The ambient light filter is, thus, employed to reduce the transmission of ambient light to the phototransistor. In this manner, a user may view the segments while the ambient light wavelengths are reduced, thus, preventing false positive signals which might otherwise be generated by the phototransistors. Preferably, the display monitor is employed in railroad applications in which the proper performance of each segment is of vital importance.

As one aspect of the invention, a monitoring system for a display unit comprises means for detecting light emitted from a plurality of selectively energizable light-emitting segments in an energized state and for generating an electrical signal which is representative of the light emitted from the light-emitting segments in the energized state; and means for filtering ambient light from the means for detecting light and for passing the light emitted from the light-emitting segments in the energized state. A means generates a comparison signal for each of the light-emitting segments, with the comparison signal being representative of a comparison between a predetermined reference signal and the electrical signal for each of the light-emitting segments. A means conditionally energizes the light-emitting segments in response to an energizing signal. A means provides display data. A means receives the comparison signal for each of the light-emitting segments and generates the energizing signal in order to operate the means for conditionally energizing when the comparison signal for each of the light-emitting segments indicates that each of the light-emitting segments is operating fault-free. A means cooperates with the means for conditionally energizing and the means for receiving the comparison signal for selectively gating the display data to the light-emitting segments.

Preferably, the ambient light has at least one wavelength, the light emitted from the light-emitting segments in the energized state has a wavelength which is different than the wavelength of the ambient light, and the means for filtering is a glass filter which filters the wavelength of the ambient light and which passes therethrough the wavelength of the light-emitting segments in the energized state.

As another aspect of the invention, a monitoring system for a display unit comprises photovoltaic means for detecting light emitted from a plurality of selectively energizable light-emitting segments which are grouped to form desired shapes, symbols and/or alphanumeric characters in an energized state and for generating an electrical signal having a voltage which is representative of the light emitted from the light-emitting segments in the energized state, and means for filtering ambient light from the photovoltaic means and for passing the light emitted from the light-emitting segments in the energized state. A means generates a comparison signal for each of the light-emitting segments, with the comparison signal being representative of a comparison between a predetermined reference voltage and the voltage which is representative of the light emitted from the light-emitting segments in the energized state for each of the light-emitting segments. A means conditionally energizes the light-emitting segments in response to an energizing signal. A means receives the comparison signal for each of the light-emitting segments and generates display data and the energizing signal in order to operate the means for conditionally energizing when the comparison signal for each of the light-emitting segments indicates that each of the light-emitting segments is operating fault-free. A means cooperates with the means for conditionally energizing and the means for receiving the comparison signal for selectively gating the display data to the light-emitting segments.

As a further aspect of the invention, a method of monitoring a light-emitting display device comprises filtering ambient light from a plurality of selectively energizable display segments and passing the light emitted from the display segments in the energized state; detecting light emitted from the display segments in the energized state and generating an electrical signal which is representative of the light emitted from the display segments in the energized state; comparing a predetermined reference signal and the electrical signal for each of the display segments and generating a comparison signal which is representative thereof; employing the comparison signal for each of the display segments and generating an energizing signal when each of the display segments is operating fault-free; providing display data; selectively gating the display data to the display segments; and de-energizing the display segments when the display segments are not operating fault-free.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
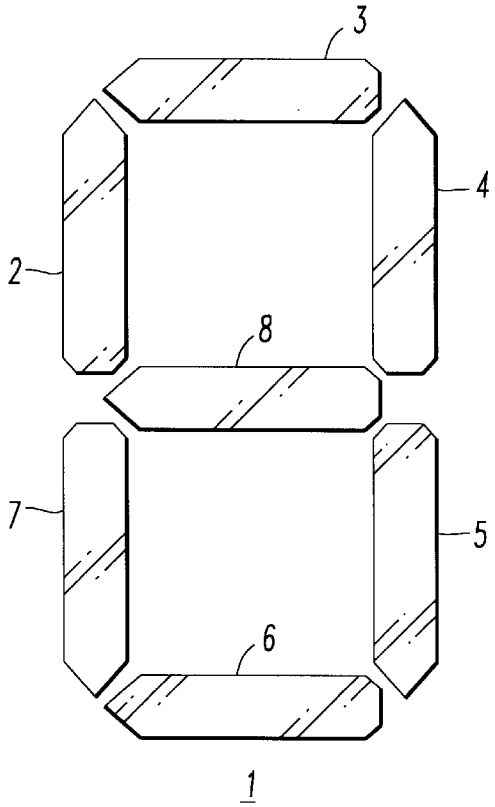
FIG. 1 PRIOR ART
FIG. 1 is a top view of a typical seven-segment LED display with the segments arranged to display various shapes, symbols and/or alphanumeric characters.
Figure 2:
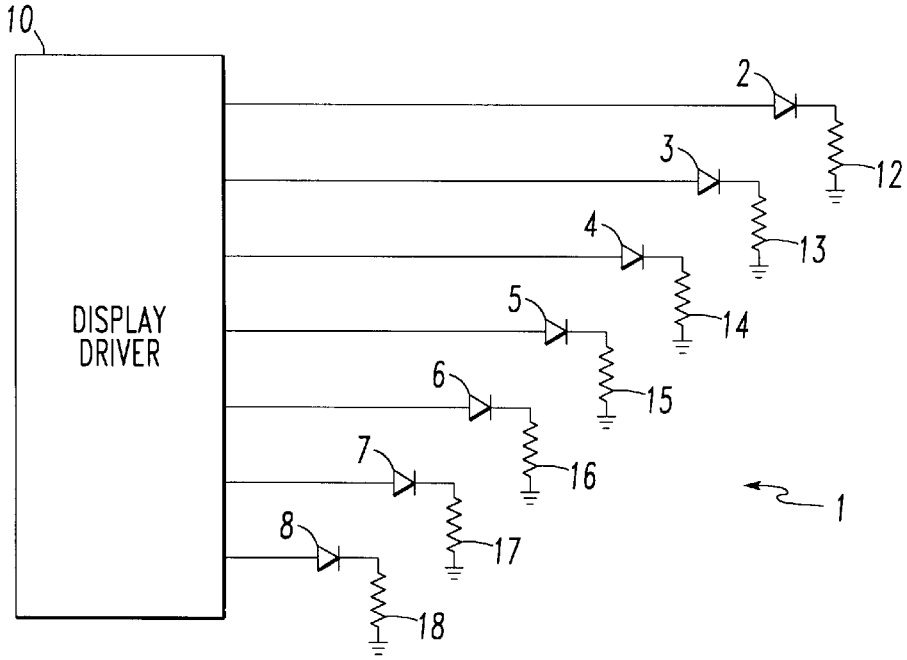
FIG. 2 PRIOR ART
FIG. 2 shows a circuit diagram of a typical display driver which selectively and separately drives seven independent LEDs.
Figure 3:
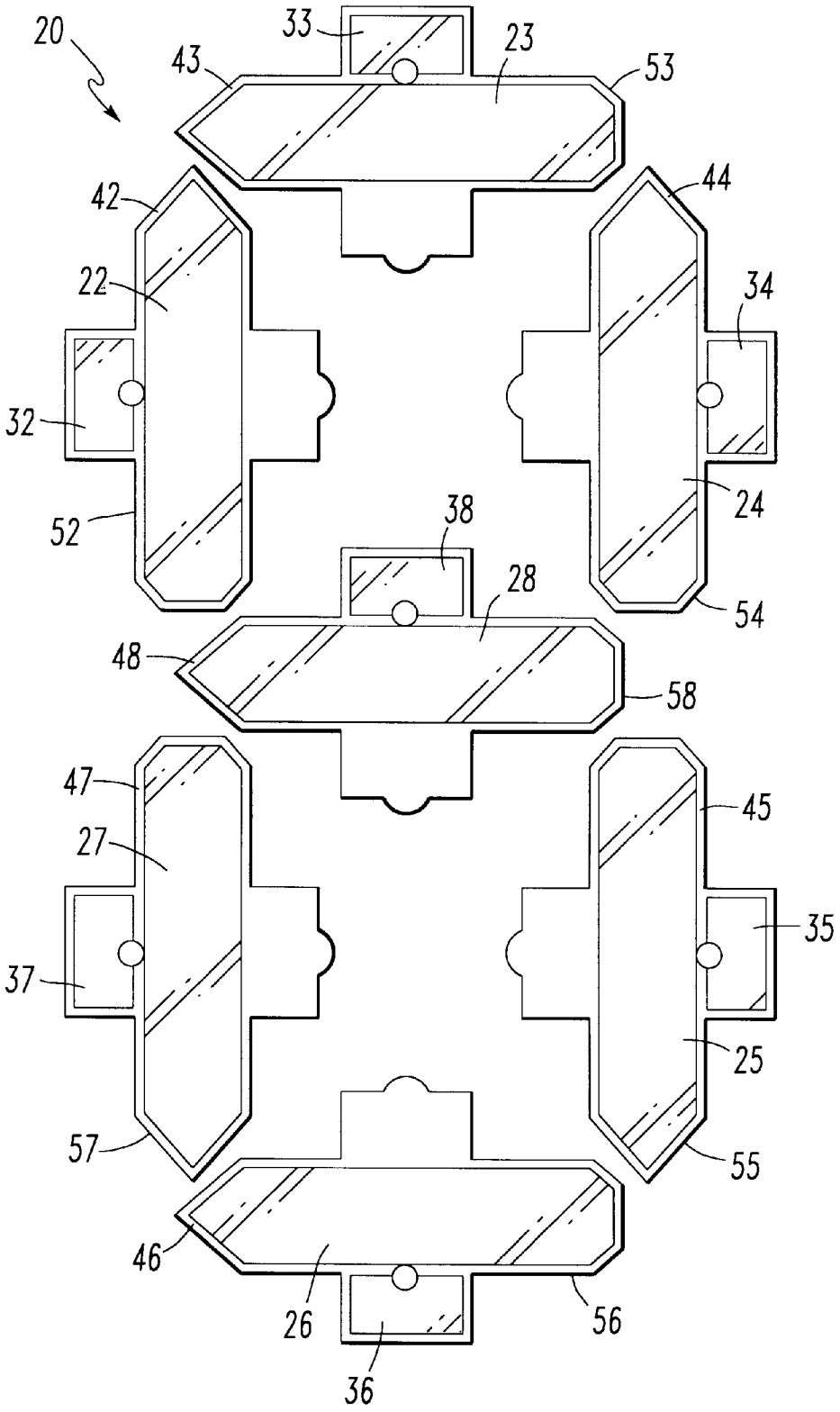
FIG. 3 is a top view of LED segments and phototransistors being surrounded by respective light-preventive shields in accordance with a preferred embodiment of the present invention.

Referring to FIG. 3, a seven-segment display 20 includes segments 22, 23,24,25,26,27,28 having photo-transistors 32,33,34,35,36,37,38 enclosed within independent defined areas 42,43,44,45,46,47,48 by shields 52,53,54,55,56,57,58, respectively.

Figure 4:
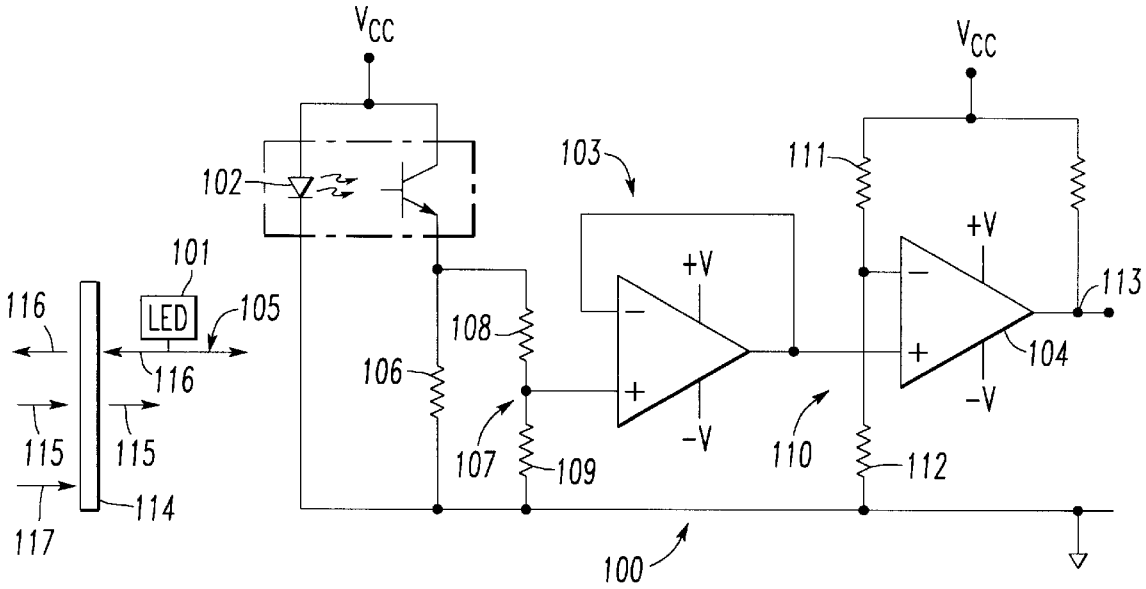
FIG. 4 is a circuit diagram which monitors a particular LED segment in accordance with a preferred embodiment of the present invention.

Referring to FIG. 4, an LED segment monitoring circuit 100 monitors a particular selectively energizable LED segment 101, which has a non-energized state and an energized state. The LED segment 101 emits light in the energized state. It will be appreciated that the LED segment 101 may be grouped with other LED segments (e.g., as shown in FIG. 3) to form desired shapes, symbols and/or alphanumeric characters when emitting light in the energized state.

The monitoring circuit 100 includes a single photovoltaic mechanism such as phototransistor 102, a unity gain buffer 103, and a comparator 104. The phototransistor 102 is employed to detect light emissions in the energized state of the single LED segment 101, which is one of the LED segments of a plural segment LED display (e.g., as shown by seven-segment display 20 in FIG. 3). The phototransistor 102 generates an electrical signal having a voltage which is representative of the light emitted from the LED segment 101 in the energized state. In turn, the level output by the phototransistor 102 is buffered by buffer 103 and, then, is compared to a fixed value by the comparator 104 to determine if the particular LED segment 101 is off or on.

When the LED segment 101 is on, LED light 105 turns the phototransistor 102 on, thereby causing the voltage on its emitter and across resistor 106 to rise. This emitter voltage is sent to a voltage divider 107 formed by the series combination of resistors 108,109. Then, the output voltage of the divider 107 is buffered by the unity gain buffer or op-amp 103. A voltage divider 110 is formed by the series combination of resistors 111,112 between a positive DC voltage ($V_{CC}$) and ground. The predetermined reference voltage of the output of the divider 110 is input by the negative (−) input of the comparator 104. The output voltage of the op-amp 103 is input by the positive (+) input of the comparator 104. The comparator 104, thus, compares the output voltage of the op-amp 103 to the predetermined reference voltage level as set by the voltage divider 110. In turn, the signal of the output 113 of the comparator 104 is employed to verify that the LED segment 101 is, indeed, emitting light. Preferably, the unity gain buffer 103 and the comparator 104 are powered by positive (+V) and negative (−V) DC voltages.

Continuing to refer to FIG. 4, a suitable filter 114 is employed which permits transmission of certain wavelengths 115,116 of light therethrough while filtering or blocking other wavelengths 117 of ambient light from the phototransistor 102. In this manner, the filter 114 passes the LED light 105 emitted from the LED segment 101 in the energized state. Thus, the operator may see the LED segments, such as 101, while the filter 114 reduces ambient light wavelengths, such as 117, that the phototransistor 102 would, otherwise, respond to and, thereby, generate false-positive signals. In this manner, the exemplary monitoring circuit 100 permits the exemplary LED segment 101 to function properly in viewing areas having, for example, over 5000 foot-candles of ambient light.

Since the display (e.g., display 20 of FIG. 3) formed by the LED segments, such as 22–28 or 101, has an opening (not shown) to allow the operator to see each LED segment of the display, without the filter 114, it would otherwise be possible for ambient light, such as light having the wavelength 117 of FIG. 4, to reach the phototransistor 102 which is employed to detect operation of the LED segment 101.

The LED light 105 emitted from the LED segment 101 in the energized state has a wavelength, such as wavelength 116, which is different than the wavelength 117 of the ambient light. In this manner, the filter 114 filters the wavelengths, such as wavelength 117, of ambient light and passes therethrough the wavelength 116 of the LED segment 101 in the energized state.

Figure 5:
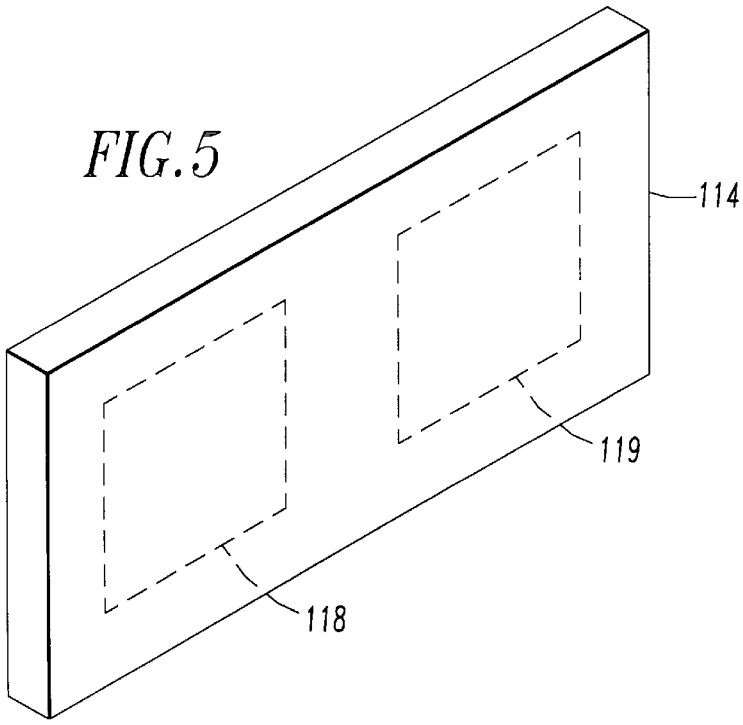
FIG. 5 is a perspective view of a filter for two exemplary light-emitting displays in accordance with a preferred embodiment of the present invention.

FIG. 5 shows the exemplary filter 114 for two exemplary light-emitting displays 118,119 of a display unit or display device. The filter 114 is preferably made of optical glass of suitable size and thickness for the two seven-segment LED displays 118,119 (e.g., as shown by display 20 in FIG. 3), although the same filter may be employed for one, three or more of such displays, or a single filter may be employed for each segment, such as LED segment 101, and its corresponding detector, such as phototransistor 102 of FIG. 4. Preferably, the optical glass is bonded directly to the outer display surface of the LED segments (e.g., segments 22–28 of FIG. 3) of displays 118,119 with a suitable glue, such as RTV.

As a non-limiting example, an optical glass of about 0.04" thickness, 1.25" height and 2.3" width may be employed for the two exemplary seven-segment LED displays 118,119.

As a further non-limiting example, a suitable type of optical glass is part number 550WB300 marketed by Omega Optical. The optical glass preferably has a center wavelength (CWL) of about 550 +/−30 nm which is approximately intermediate the range of visible light (e.g., about 380–400 nm, which is the blue end of ultraviolet (UV), to about 750–780 nm, which is the red end of infrared (IR)). The CWL is defined to be the arithmetic center of the passband of a bandpass filter. Also, the full width at half maximum transmission (FWHM), which is defined to be the width of the passband of the bandpass filter, as referenced to the points (i.e., 3 dB) on the cut-on and cut-off edge where the transmission is attenuated by one-half, is about 300 +/−60 nm. Thus, the optical glass nominally passes light in the range of about 400–700 nm. For example, the optical density (OD or $-\log_{10}$(transmission)) of the optical glass for UV light at about 350 nm would be about 3.0, thereby permitting transmission of about 0.1% of the incident ambient UV light, while the OD for IR light at about 800–1100 nm would be about 1.3, thereby permitting transmission of about 5.0% of the incident ambient IR light. In this example, the optical glass is particularly effective in substantially reducing external UV light from fluorescent lighting.

It will be appreciated that optical glass may employ a passband which is substantially defined by the transmission wavelength of the LED segments, thereby attenuating external light which has wavelengths different from the transmission wavelength.

Figure 6:
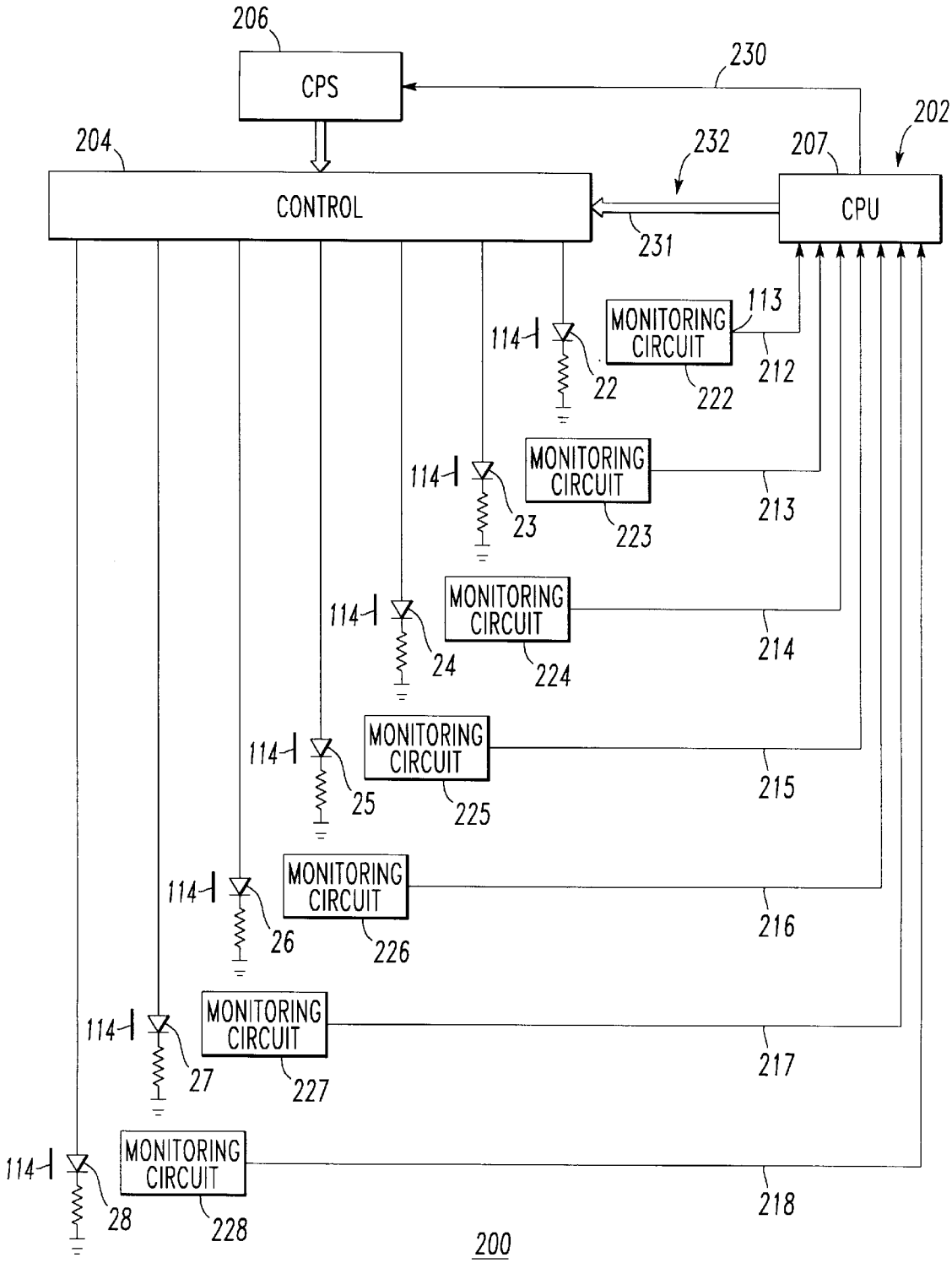
FIG. 6 is a functional block diagram of a monitoring system in accordance with a preferred embodiment of the present invention wherein a central processing unit (CPU) operates a control block and a conditional power supply (CPS) based on a closed monitoring test loop which provides feedback from each of the independently monitored segments.

FIG. 6 is a functional block diagram of a monitoring system 200 in which a central processing unit (CPU) 202 operates a control block 204 and a conditional power supply (CPS) 206 based on a closed monitoring test loop 207 which provides feedback from each independently monitored segment. The CPU 202 receives as feedback output voltages 212,213,214,215,216,217,218 which are supplied from monitoring circuits 222,223,224,225,226,227,228 (e.g., like monitoring circuit 100 of FIG. 4) that monitor segments 22,23,24,25,26,27,28 (e.g., like LED segment 101 of FIG. 4), respectively. The CPU 202 generates a conditional energizing signal 230 that is employed by the CPS 206 to provide power to the control block 204. In a preferred embodiment, the conditional signal 230 is a square wave with frequency of about 500 Hz. The CPU 202 also generates display data 231 through a bus 232 to the control block 204 which independently drives each of the segments 22,23, 24,25,26,27, 28, and, thus, conditionally energizes the segments in response to the signal 230 and, as discussed below, de-energizes the segments when such segments are not operating fault-free.

In a preferred embodiment, the CPS 206 is a vital conditional power supply which is designed as a fail-safe hardware component. The CPS 206 receives input from a battery (not shown) and the conditional signal 230 from the CPU 202, preferably via dedicated hardware (not shown). The control block 204 switches the display data 231 received through the bus 232 to the segments 22,23,24,25, 26,27,28 as long as the CPU 202 provides the conditional signal 230 to the CPS 206, thereby indicating that the segments are operating properly based on feedback received from each monitoring circuit 222–228 of each respective segment 22–28. The conditional signal 230 provided by the CPU 202 verifies that a fault-free condition was determined by the CPU 202 and that each segment 22–28 is functioning properly based on feedback received from each respective monitoring circuit 222–228. If the CPU 202 stops providing the conditional signal 230, thereby indicating that the segments are not operating properly, then the CPS 206 stops supplying power to the control block 204 and, thus, to each segment, thereby forcing all segments to the fail-safe condition of not emitting light. The control block 204 cooperates with the CPS 206 and the CPU 202 for selectively gating the display data 231 to the segments 22–28. Accordingly, in response to the detection of a segment error, all the segments are dark and, thus, are not emitting light. Hence, the Aspect Display Unit (not shown) is not providing an incorrect display that may, otherwise, be unsafe.

In summary, the CPU 202 receives the comparison signal of the output 113 of the comparator 104 (as shown in FIG. 4) for each of the segments 22–28 and generates and provides display data 231 through bus 232 and the conditional signal 230 in order to operate the CPS 206 when the comparison signals for such segments indicate that each segment is operating fault-free.

In operation, each segment 22,23,24,25,26,27,28 is independently and selectively energizable to an energized (on) state wherein the segment emits light, and to a non-energized (off) state wherein the segment does not emit light.

For vitality in operation, each of the segments 22–28 is preferably subjected to a "flip" test wherein each segment is independently switched from its current "on" or "off" state to the opposite "off" or "on" state, preferably for about 1 $\mu$s, and then returned to its current "on" or "off" state, respectively. During the period that each segment is independently switched to its opposite state, each of the phototransistors 102 (FIG. 4) senses light emanating within each area (e.g., areas 42, 43,44,45,46,47,48 of FIG. 3) defined by its shield (e.g., shields 52,53,54,55,56,57, 58 of FIG. 3) for each segment. Each monitoring circuit (e.g., circuits 222,223,224, 225,226,227,228 of FIG. 6) provided for each segment provides to the CPU 202 a respective output (i.e., 113 of FIG. 4) that is representative of a malfunctioning segment, based upon the comparison of the fixed voltage output by the divider 110 of FIG. 4 and the voltage provided by the phototransistor 102 that is sensing light for each LED segment. In this manner, each particular LED segment is independently monitored and tested. This test is provided periodically, preferably about once per second, thereby providing a closed loop test in order to provide early fault detection. In this manner, corrective action, such as removing power supplied to the LED segments, may be taken immediately upon detection of a fault.

While exemplary LEDs and LED segments have been shown, other light-emitting sources, such as incandescent bulbs or fiber optic displays, for example, may equivalently be employed. Also, the exemplary CPU 202 and control block 204, for example, may provide inputs to, and receive outputs from, other components or circuits (not shown).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A monitoring system for a display unit including a plurality of selectively energizable light-emitting segments, each of said light-emitting segments having an energized state and a non-energized state, with said light-emitting segments emitting light in said energized state, said monitoring system comprising:

means for detecting light emitted from said light-emitting segments in said energized state and for generating an electrical signal which is representative of said light emitted from said light-emitting segments in said energized state;

means for filtering ambient light from said means for detecting light and for passing said light emitted from said light-emitting segments in said energized state;

means for generating a comparison signal for each of said light-emitting segments, with said comparison signal being representative of a comparison between a predetermined reference signal and said electrical signal for each of said light-emitting segments;

means for conditionally energizing said light-emitting segments in response to an energizing signal;

means for providing display data;

means for receiving said comparison signal for each of said light-emitting segments and generating said energizing signal in order to operate said means for conditionally energizing when said comparison signal for each of said light-emitting segments indicates that each of said light-emitting segments is operating fault-free; and means cooperating with said means for conditionally energizing and said means for receiving said comparison signal for selectively gating said display data to said light-emitting segments.

2. The system as recited in claim 1, wherein said means for receiving said comparison signal cooperates with said means for conditionally energizing in order to switch each of said light-emitting segments having said energized state to said non-energized state for a predetermined time and then back to said energized state, and to switch each of said light-emitting segments having said non-energized state to said energized state for said predetermined time and then back to said non-energized state; and wherein during said predetermined time said means for generating a comparison signal generates said comparison signal for each of said light-emitting segments.

3. The system as recited in claim 2, wherein each of said light-emitting segments is switched periodically.

4. The system as recited in claim 3, wherein said predetermined time is about one microsecond.

5. The system as recited in claim 2, wherein each of said light-emitting segments is switched about once per second.

6. The system as recited in claim 5, wherein said predetermined time is about one microsecond.

7. The system as recited in claim 1, wherein said means for receiving said comparison signal cooperates with said means for conditionally energizing in order to switch each of said light-emitting segments having said energized state to said non-energized state for a first predetermined period and then back to said energized state, and to switch each of said light-emitting segments having said non-energized state to said energized state for a second predetermined period which is different than said first predetermined period, and then back to said non-energized state; and wherein during said first and second predetermined periods said means for generating a comparison signal generates said comparison signal for each of said light-emitting segments.

8. The system as recited in claim 7, wherein each of said light-emitting segments is switched periodically.

9. The system as recited in claim 8, wherein said first predetermined period is about one microsecond.

10. The system as recited in claim 7, wherein each of said light-emitting segments is switched about once per second.

11. The system as recited in claim 10, wherein said first predetermined period is about one microsecond.

12. The system as recited in claim 1, wherein said ambient light has at least one wavelength; wherein said light emitted from said light-emitting segments in the energized state has a wavelength which is different than said at least one wavelength of said ambient light; and wherein said means for filtering is a glass filter which filters said at least one wavelength of said ambient light and which passes therethrough said wavelength of said light-emitting segments in the energized state.

13. A monitoring system for a display unit including a plurality of selectively energizable light-emitting segments, each of said light-emitting segments having an energized state and a non-energized state, with said light-emitting segments being grouped to form desired shapes, symbols and/or alphanumeric characters when emitting light in said energized state, said monitoring system comprising:

photovoltaic means for detecting light emitted from said light-emitting segments in said energized state and for generating an electrical signal having a voltage which is representative of said light emitted from said light-emitting segments in said energized state;

means for filtering ambient light from said photovoltaic means and for passing said light emitted from said light-emitting segments in said energized state;

means for generating a comparison signal for each of said light-emitting segments, with said comparison signal being representative of a comparison between a predetermined reference voltage and said voltage which is representative of said light emitted from said light-emitting segments in said energized state for each of said light-emitting segments;

means for conditionally energizing said light-emitting segments in response to an energizing signal;

means for receiving said comparison signal for each of said light-emitting segments and generating display data and said energizing signal in order to operate said means for conditionally energizing when said comparison signal for each of said light-emitting segments indicates that each of said light-emitting segments is operating fault-free; and means cooperating with said means for conditionally energizing and said means for receiving said comparison signal for selectively gating said display data to said light-emitting segments.

14. The system as recited in claim 13, wherein said means for receiving said comparison signal cooperates with said means for conditionally energizing in order to switch each of said light-emitting segments having said energized state to said non-energized state for a predetermined time and then back to said energized state, and to switch each of said light-emitting segments having said non-energized state to said energized state for said predetermined time and then back to said non-energized state; and wherein during said predetermined time said means for generating a comparison signal generates said comparison signal for each of said light-emitting segments.

15. The system as recited in claim 14, wherein each of said light-emitting segments is switched periodically.

16. The system as recited in claim 15, wherein said predetermined time is about one microsecond.

17. The system as recited in claim 14, wherein each of said light-emitting segments is switched about once per second.

18. The system as recited in claim 17, wherein said predetermined time is about one microsecond.

19. The system as recited in claim 13, wherein said ambient light has a plurality of wavelengths; wherein said light emitted from said light-emitting segments in the energized state has a wavelength which is different than said wavelengths of said ambient light; and wherein said means for filtering is a glass filter which filters said wavelengths of said ambient light and which passes therethrough said wavelength of said light-emitting segments in the energized state.

20. A method of monitoring a light-emitting display device including a plurality of selectively energizable display segments, each of said display segments having an energized state and a non-energized state, with said display segments emitting light in said energized state, said method comprising the steps of:

filtering ambient light from said display segments and passing said light emitted from said display segments in said energized state;

detecting said light emitted from said display segments in said energized state and generating an electrical signal which is representative of said light emitted from said display segments in said energized state;

comparing a predetermined reference signal and said electrical signal for each of said display segments and generating a comparison signal which is representative thereof;

employing said comparison signal for each of said display segments and generating an energizing signal when each of said display segments is operating fault-free;

providing display data;

selectively gating said display data to said display segments; and de-energizing said display segments when said display segments are not operating fault-free.

21. The method as recited in claim 20, said method further comprising the steps of:

de-energizing each of said display segments which is in said energized state and energizing each of said display segments which is in said de-energized state; and re-energizing each of said display segments which is in said de-energized state and de-energizing each of said display segments which is in said energized state.

* * * * *